United States Patent [19]

Hayashi

[11] 4,150,501

[45] Apr. 24, 1979

[54] HANDY SNOW PLOUGH

[75] Inventor: Yoshitsugu Hayashi, Gyoda, Japan

[73] Assignee: More Corporation, Tokyo, Japan

[21] Appl. No.: 843,618

[22] Filed: Oct. 19, 1977

[30] Foreign Application Priority Data

Feb. 9, 1977 [JP] Japan ..... 52-14426[U]

[51] Int. Cl.[2] ..... E01H 5/00

[52] U.S. Cl. ..... 37/43 B; 37/53

[58] Field of Search ..... 37/43 R, 43 A, 43 B, 37/43 C, 43 D, 43 E, 43 F, 43 G, 43 H, 43 K, 43 L, 53, 20–27

[56] References Cited

U.S. PATENT DOCUMENTS

| | | | |
|---|---|---|---|
| 1,574,230 | 2/1926 | Brown | 37/43 B |
| 2,536,166 | 1/1951 | Garland | 37/43 B |
| 2,731,739 | 1/1956 | Miller | 37/43 E |
| 2,735,199 | 2/1956 | Wanner et al. | 37/43 E |
| 3,074,189 | 1/1963 | Phelps | 37/53 X |
| 3,200,519 | 8/1965 | Kennedy | 37/53 X |
| 3,484,963 | 12/1969 | Heth et al. | 37/43 E |
| 3,795,068 | 3/1974 | Brunner | 37/43 D |
| 3,921,315 | 11/1975 | Tome | 37/43 R |

FOREIGN PATENT DOCUMENTS

| | | | |
|---|---|---|---|
| 2251847 | 10/1972 | Fed. Rep. of Germany | 37/43 E |
| 552191 | 11/1956 | Italy | 37/43 R |
| 426911 | 6/1967 | Switzerland | 37/43 R |

*Primary Examiner*—E. H. Eickholt

*Attorney, Agent, or Firm*—Frank J. Jordan

[57] ABSTRACT

A manually operable mobile snow plough includes a streamlined main body supported upon wheels or runners for movement over the ground or snow. The main body has one or more entrance openings for receiving snow, and at least one blade mounted rotatably within such openings. A snow discharge pipe is rotatably carried by the snow plough body and is provided with a vertically extending discharge slot. A snow guide member is pivotably mounted atop the discharge pipe, and an adjusting lever is included to permit setting of the discharge pipe in any one of a series of selected azimuthal positions.

14 Claims, 3 Drawing Figures

HANDY SNOW PLOUGH

BACKGROUND OF THE INVENTION

This invention relates to hand snow ploughs and more particularly, to hand snow ploughs which are particularly suitable for removal of snow drifts which have accumulated on grounds and/or roads about and in the vicinity of residences and other relatively small buildings.

There have been proposed and employed a great variety of hand snow ploughs for the above purpose. However, since most of the conventional hand snow ploughs are mere miniatures or reduced size counterparts of full size snow ploughs employed in large scale snow removal operations, such conventional hand snow ploughs are so complicated in construction, difficult and prohibitively expensive that such ploughs are impractical for small scale use.

Further the conventional had snow ploughs are designed to discharge the snow ploughed of the character described in only one fixed direction. Therefore, the snow ploughs are not useful in areas where the discharge and removal of the ploughed snow is impossible in the predetermined fixed direction designed into such ploughs.

SUMMARY OF THE INVENTION

Therefore, one object of the present invention is to provide an improved, and hand snow plough which is simple in construction, easy to operation and relatively inexpensive.

Another object of the present invention is to provide a hand snow plough which is capable of varying the ploughed snow discharge and removal direction as desired to meet specific topographical conditions in the areas where the snow ploughs are operated.

A further object of the present invention is to provide an improved and novel hand snow plough which can be easily operated even by housewives, and other persons who may be awkward at machine operation.

According to the present invention, there has been provided a mobile snow plough comprising at least one main body having a generally box-like configuration and an open front end, a drive shaft mounted rotatably and horizontally within the body, a snow collecting and propelling blade carried by the drive shaft for rotation therewith, prime mover means for driving the drive shaft, a snow discharge pipe mounted rotatably on the body and adapted to receive snow propelled by the blade and to discharge the snow in a selected azimuthal direction, and adjusting means for selectively fixing the discharge pipe in any one of a plurality of horizontal angular settings to thereby determine the horizontal direction in which the snow is discharged.

The above and other objects and attendant advantages of the present invention will be more readily apparent to those skilled in the art from a reading of the following detailed description in connection with the accompanying drawings which show preferred embodiments of the invention for illustration purpose only, but not for limiting the scope of the same in any way.

BRIEF DESCRIPTION OF THE DRAWINGS

The accompanying drawings show preferred embodiments of hand snow ploughs constructed in accordance with the present invention in which.

PREFERRED EMBODIMENTS OF THE INVENTION

Figure 1:
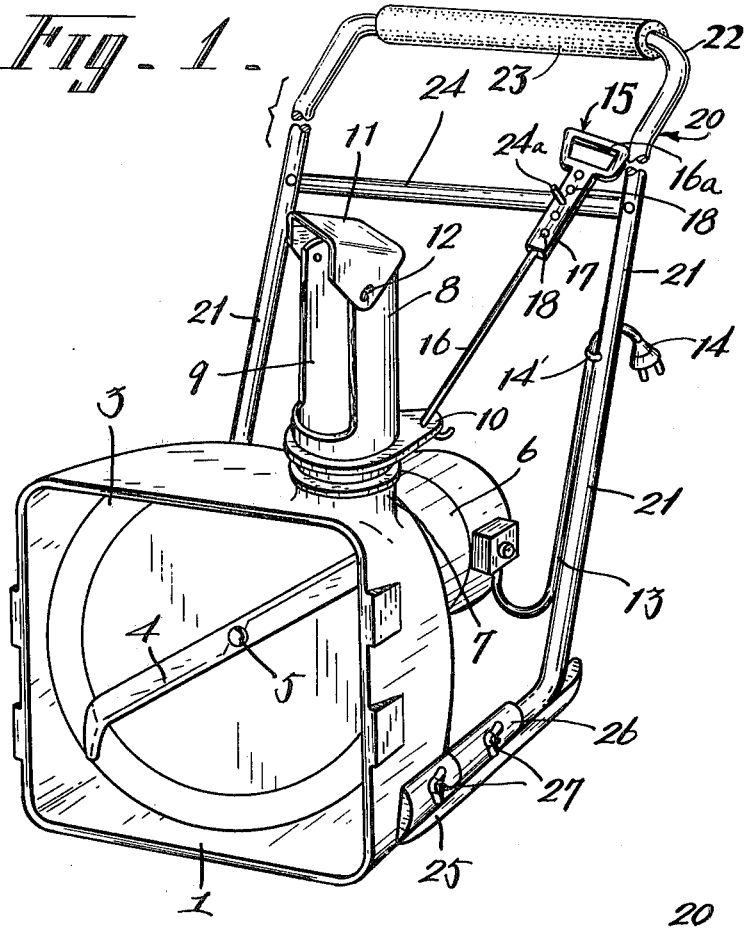
FIG. 1 is a perspective view of a first preferred embodiment of hand snow plough constructed in accordance with the present invention.

The present invention will be now described referringto the accompanying drawings which show preferred embodiments of the hand snow plough of the invention for illustration purpose only, but not for limiting the scope of the same in any way. First, referring to FIG. 1 of the drawings in which the first preferred embodiment of the snow plough of the invention is shown, the hand snow plough generally comprises a hollow main body 1 which has a generally square box shape open at the front and partially open at the top. The top, bottom and side walls which define the hollow interior within the main body 1 together with the rear wall 2 slope or are faired gradually towards the rear wall to give a streamlined external shape to the main body 1 and provide a circular rear portion 3 for the purpose to be described hereinafter. A snow stirring and throwing blade 4 is disposed vertically within the rear portion 3 of the main body 1 in coaxial relationship with longitudinal axis of the the main body. The blade is carried in the center thereof on a horizontal rotatable shaft 5 which extends through the rear wall 2 and is drivingly connected to a prime mover such as an electric motor 6 mounted on the outer surface of the main body rear wall 2. The circular rear portion 3 of the main body 1 has a circular opening (not shown) in its upper surface in a position tangential to the blade 4. A circular cylindrical riser 7 integrally extends upwardly from the circular opening in the circular rear portion 3 and a snow discharge pipe 8 is rotatably and adjustably received in the riser 7.

The snow discharge pipe 8 vertically extending substantially rectangular snow discharge opening 9 in its peripheral wall extending from a position adjacent its lower end to and through its upper end. A bracket 10 is provided in a position below the opening 9. The upper ends of the side walls of the vertical opening 9 are bevelled and the portions of the upper end of the circular snow discharge pipe 8 which are contiguous to the bevelled upper ends of the opening side walls are also bevelled in the reverse direction with respect to the bevelling of the side walls of the discharge pipe opening 9. A snow guide member 11 of substantially inverted U-shaped cross-section as seen in side elevation is pivotably mounted on the opposite legs thereof, on the upper end of the snow discharge pipe 8 by means of pivot pins 12. An electric cord 13 extends from the electric motor 6 and has a plug 14 at the other or outer end for connection to an accessible power source receptacle (not shown). The rotatable and adjustable snow discharge pipe 8 may be adjusted in its azimuthal direction by an operation lever 15 having a shank 16 which is connected at one or the lower end to the bracket 10 on the snow discharge pipe 8 and with to a grip **16*a* integral with the shank. The shank of lever 15 has an enlarged portion 17 having a plurality of through holes 18** therein for the purpose to be described hereinafter.

The plough is provided with a U-shaped operation handle 20 including a pair of opposite legs 21, 21 and an intermediate arm 22 integral with and connecting the adjacent ends of the legs.

The upper portion of each of the legs 21 inclines rearwardly at an angle with respect to the main body 1 and the lower portion of each leg integral with the upper leg portion extends horizontally and is secured at its leading or free end to the associated side wall of the main body 1 in a manner as will be described hereinafter. A tubular rubber grip 23 is mounted on the arm 22 of the handle 20 for the comfort the user. The handle 20 further has a cross bar 24 extending between and secured at the opposite ends thereof to the two legs 21, 21 of the handle 20. A pin **24*a* is provided on cross bar 24 for slective engagement in the holes 18 of lever 15** for the purpose to be described hereinafter.

The body of the snow plough is supported on a sleigh 25 which extends along the undersurfaces of the circular rear portion 3 of the main body 1 and of the horizontal lower portions of the handle legs 21 with the rear end of the sleigh extending beyond the rear ends of the lower leg portions. Handle holding members 26, 26 are fixedly mounted on the opposite sides of the main body 1 and serve to hold the lower horizontal portions of the legs 21 in fixed relation to the main body of the plough. In order to secure the main body 1, handle 20 and sleigh 25 together in such fixed relation screwnuts 27 are threaded into aligned threaded holes not shown in the main body 1 and in the horizontal lower portions of the handle legs 21. When the snow plough is not operated or is in its stowed position, the electric cord 13 is hooked to one of the handle leg 21 at 14' as shown in FIG. 1.

With the above-mentioned construction and arrangement in operation, the snow plough can be easily moved on the sleign 25 to a desired place in the vicinity of or about the user's house where the ground is covered with the snow which is to be removed by the gripping and pushing of the handle by the user. The main body 1 is plunged into the drifted snow and the plug 14 on the electric cord 13 is inserted into the mating receptacle (not shown) on an accessible power source (not shown) and the electric motor 6 is switched on. If the snow covered ground is located far away from the power source, beyond the reach of the electric cord 13, any conventional electrical extension can be used to connect the electric cord and power source. The insertion of the plug 14 into the power source receptacle energizes the electric motor 6 which in turn drives or rotates the rotary drive shaft 5 and accordingly, the snow stirring and throwing blade 4 thereon. When the blade 4 is driven in the manner mentioned hereinabove, the blade ploughs and propels the snow upwardly into the snow discharge pipe 8 by the action of the centrifugal force produced by the rotation of the blade while concomitantly stirring up or loosening the mass of drifted snow. The thus loosened and propelled snow is discharged out of the opening 9 in the snow discharge pipe 8. Since the snow guide member 11 is pivotable on pipe 8, the snow can be discharged out of the pipe opening 9 at any desired angle in the vertical direction by pivotally moving the guide member 11 within the pivotal movement range of the member. Also, since the pin **24*a* on the handle 20 is adapted to be selectively inserted into any of the holes 18 in the lever 15, when it is desired to vary the horizontal or azimuthal discharging direction of the loosened and thrown snow out of the discharge pipe 8 the user pulls the lever 15 to thereby rotate the discharge pipe 8 through the desired angle. The pin 24*a* from the hole in which it was positioned and enters another hole 18 to set the pipe 8** in the adjusted position whereby the snow can be discharged in the now adjusted direction. Thus, the present invention makes it possible to remove snow drifts even by housewives and other persons awkward at machine operation. Furthermore, since the snow plough is simple and compact in construction, the device can be produced at reduced cost.

Figure 2:
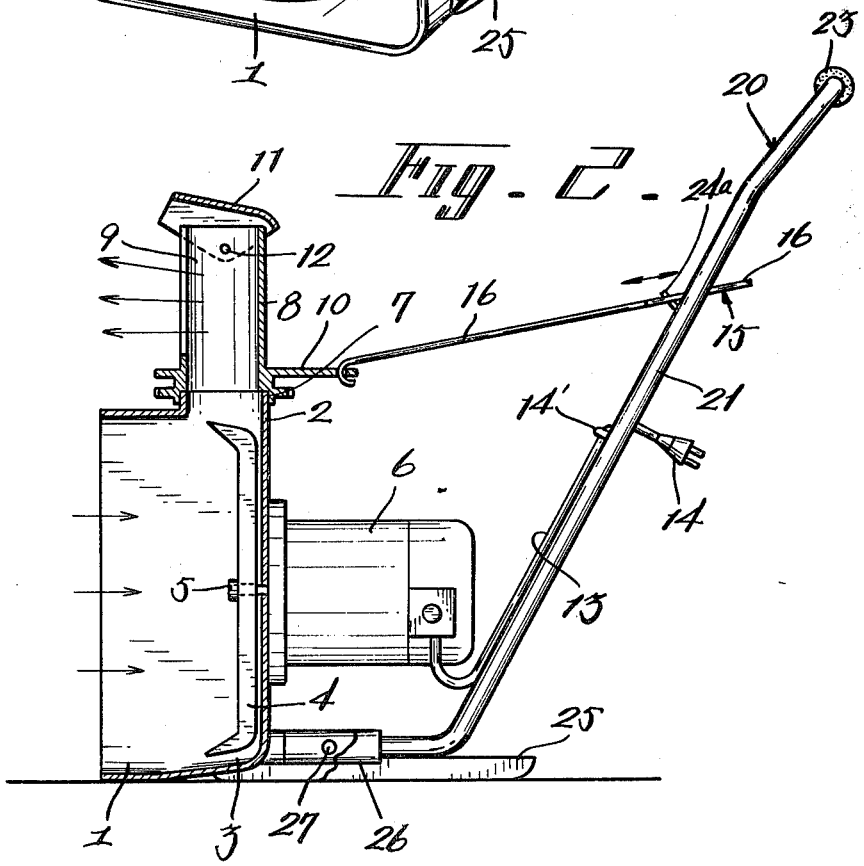
FIG. 2 is a side elevational view, partly in cross-section, of the hand snow plough as shown in FIG. 1.
Figure 3:
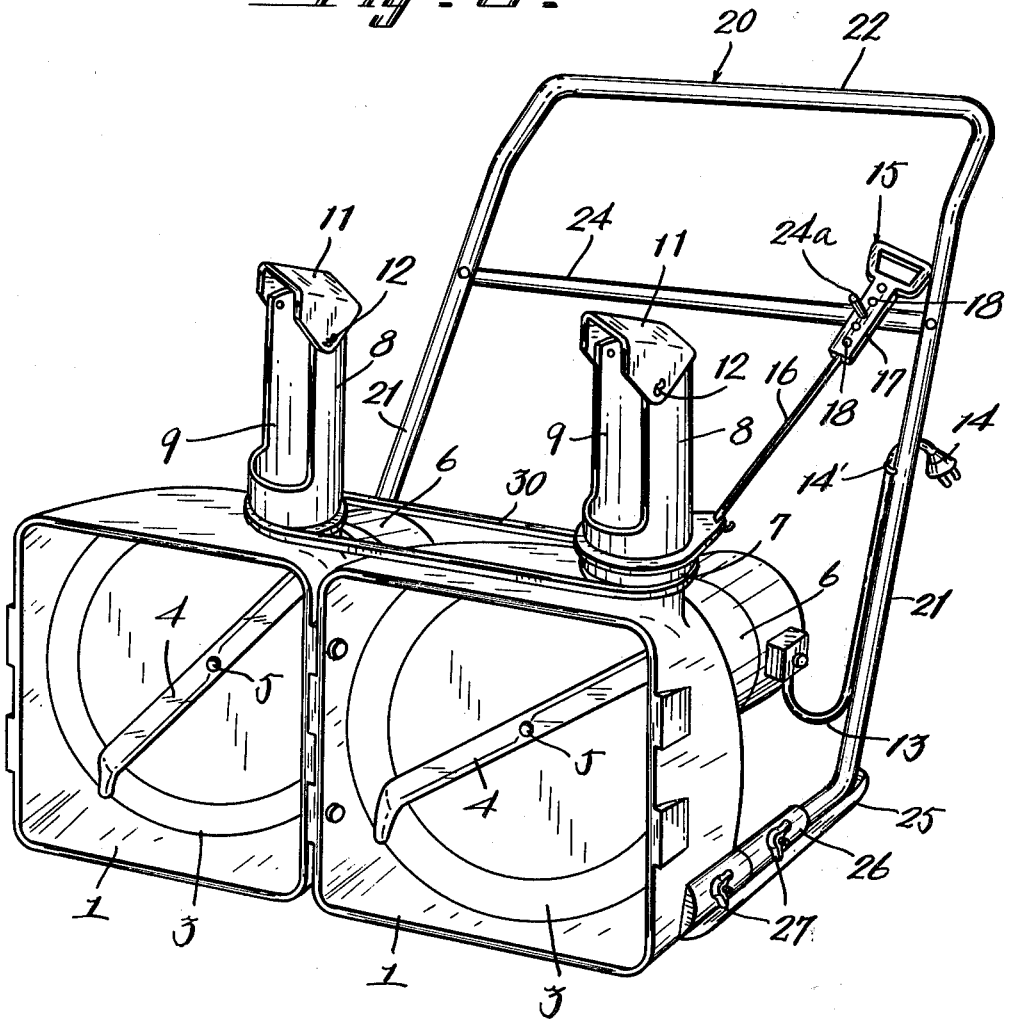
FIG. 3 is a perspective view of a second preferred embodiment of a hand snow plough constructed in accordance with the present invention.

FIG. 3 shows a second or modified embodiment of the snow plough of the invention and the parts of the second embodiment corresponding to those of the first embodiment are assigned the same numerals thereto, respectively. The handy snow plough of FIG. 3 generally comprises two hollow main bodies 1, 1 suitably connected together in side-by-side relationship. The main bodies have the same construction as the first embodiment of FIGS. 1 and 2. A snow stirring and throwing or propelling blade 4 is mounted on a rotatable drive shaft 5 similar to that of the first embodiment within the circular rear portion 2 (not shown) of each main body. Two electric motors 6, 6 are mounted on the rear walls 3, 3 (not shown) of the main bodies 1, 1, respectively, in side-by-side relationship. The electric motors 6, 6 are adapted to be connected to a common power source (not shown) through their associated electric cords 13, 13 to rotate shafts 5, 5 connected to the motors to and thereby drive the blades 4, 4 in the same manner as mentioned hereinabove in connection with FIGS. 1 and 2. An adjustable rotatable snow discharge pipe 8 is rotatably and adjustably received in a riser 7 integrally extending from the rear body portion 2 of each main body 1. The snow discharge pipes 8, 8 each have a vertical snow discharge opening 9 and a pivotable snow guide member 11 pivotably mounted at 12 as in the embodiment of FIGS. 1 and 2. One of the two snow discharge pipes or the right-hand pipe (as seen in FIG. 3) is the same as the corresponding part of the first embodiment, but the other or left-hand pipe (as seen in FIG. 3) is not provided with the bracket 10. The two snow discharge pipes 8, 8 are operatively connected together by means of an endless chain or belt 30 so that the two pipes can be simultaneously adjusted in their horizontal angular position or snow discharge direction.

The construction and operational arrangment of the other parts of the second embodiment are the same as those of the corresponding parts of the first embodiment and further detailed description on the second embodiment will be omitted herein with the understanding that the above-mentioned description on such parts can be equally applied to the second embodiment. In the second embodiment, although two electric motors 6, 6 are provided as the prime mover means for rotating the two blades 4, 4, it is also possible that the two blades are rotated by a single common prime mover or electric motor within the scope of the invention.

In any of the foregoing embodiments, the electric motor or motors 6 as the prime mover means may be replaced by any other prime mover means such as an internal combustion engine or engines without departing from the present invention. Although not shown, the snow discharge pipe or pipes 8 may have an illumination light or lights secured thereto so that the snow ploughing or removal operation by the snow plough of the invention can be performed on dark grounds and/or under bad weather conditions. Since the external contours of the main body or bodies are streamlined as mentioned hereinabove, the snow plough of the invention is not subjected to any substantial resistance by drifted snow as the snow plough advances through the drifted snow mass. It can thus easily and smoothly plough and remove the drifted snow. Although it has been described hereinabove that the snow plough is bodily supported on the sleigh for movement and operation of the plough, the snow plough can instead be supported on wheels which are suitably attached to the body or bodies and the legs of the handle within the scope of the invention.

While only two embodiments of the invention have been shown and described in detail it will be understood that the same are for illustrative purposes only and are not to be taken as limiting of the invention, reference being had for this purpose to the appended claims.

What is claimed is:

1. A mobile snow plough comprising:

at least one main body having a generally box-like configuration and an open front end;

a drive shaft mounted rotatably and horizontally within said body;

a snow collecting and propelling blade carried by said drive shaft for rotation therewith;

a prime mover means for driving said drive shaft;

a snow discharge pipe mounted rotatably on said body and adapted to receive snow propelled by said blade and to discharge said snow in a selected azimuthal direction; and adjusting means for selectively fixing said discharge pipe in any one of a plurality of horizontal angular settings to thereby determine the horizontal direction in which the snow is discharged, said adjusting means comprising a handle and a lever releasably connected between said pipe and said handle, said lever having a plurality of apertures extending longitudinally spaced relation therealong, and pin means carried by said handle positionable in a selected one of said apertures.

2. A snow plough according to claim 1, wherein said snow discharge pipe is provided with a vertically extending opening which begins adjacent to the lower end thereof and continues through the upper end thereof, a snow guide member being pivotably secured to the upper portion of said pipe to thereby regulate the direction of snow discharge vertically.

3. A snow plough according to claim 1, including sleigh means supporting said main body for movement on snow.

4. A snow plough according to claim 1, including wheel means supporting said main body.

5. A snow plough according to claim 1, wherein said prime mover means comprises at least one electric motor.

6. A snow plough according to claim 1, wherein said prime mover means comprises at least one internal combustion engine.

7. A snow plough according to claim 1, wherein said discharge pipe is mounted on said main body tangentially to the path of rotation of said blade.

8. A snow plough according to claim 1, wherein said main body includes top, side, bottom and rear walls, said top, side and bottom walls sloping gradually rearwardly towards said rear wall to thereby present a streamlined configuration.

9. A mobile snow plough comprising:

a pair of similarly constructed main bodies each having a generally box-like configuration and an open front end, said main bodies being connected in side-by-side relationships;

a drive shaft mounted rotatably and horizontally within each of said bodies;

a snow collecting and propelling blade carried by each of said drive shafts for rotation therewith;

a prime mover means for driving each of said drift shafts;

a snow discharge pipe mounted rotatably on each of said bodies and adapted to receive snow propelled by the respective blade and to discharge said snow in a selected azimuthal direction; and adjusting means for selectively fixing said discharge pipes in any one of a plurality of horizontal angular settings to thereby determine the horizontal direction in which the snow is discharged, said adjusting means comprising a handle and a lever releasably connected between one of said pipes and said handle, said lever having a plurality of apertures extending in longitudinally spaced relation therealong, pin means carried by said handle positionable in a selected one of said apertures, and an endless connection member connecting said discharge pipes, whereby manipulation of said lever provides simultaneous adjustment of the horizontal angular position of both of said discharge pipes.

10. A snow plough according to claim 9, wherein the snow discharge pipes are each provided with a vertically extending opening which begins adjacent the lower end thereof and continues through the upper end thereof, a snow guide member being pivotably secured to the upper portion of said pipe to thereby regulate the direction of snow discharge vertically.

11. A snow plough according to claim 9, including sleigh means supporting said main bodies for movement on snow.

12. A snow plough according to claim 9, including wheel means supporting said main bodies.

13. A snow plough according to claim 9, wherein said prime mover means comprises electric motors.

14. A snow plough according to claim 9, wherein said prime mover means comprises internal combustion engines.

* * * * *